US007300312B1

(12) United States Patent
Chen et al.

(10) Patent No.: US 7,300,312 B1
(45) Date of Patent: Nov. 27, 2007

(54) METHOD FOR ASSEMBLING CONNECTORS

(75) Inventors: Ying-Chung Chen, Taipei Hsien (TW); Chung-Nan Pao, Taipei Hsien (TW)

(73) Assignee: Chief Land Electronic Co., Ltd., Wu Ku Hsiang, Taipei Hsien (TW)

( * ) Notice: Subject to any disclaimer, the term of this patent is extended or adjusted under 35 U.S.C. 154(b) by 0 days.

(21) Appl. No.: 11/535,221

(22) Filed: Sep. 26, 2006

(30) Foreign Application Priority Data

Feb. 17, 2006 (TW) ..... 95105438 A

(51) Int. Cl.
*H01R 13/648* (2006.01)

(52) U.S. Cl. ..... 439/607; 439/636

(58) Field of Classification Search ..... 439/637, 439/636, 607
See application file for complete search history.

(56) References Cited

U.S. PATENT DOCUMENTS 5,634,819 A * 6/1997 Pan et al. ..... 439/637
6,913,488 B2 * 7/2005 Motojima et al. ..... 439/607
7,063,568 B2 * 6/2006 Ko ..... 439/607
2006/0121781 A1 * 6/2006 Zhang et al. ..... 439/607
2006/0121782 A1 * 6/2006 Shen et al. ..... 439/607
2006/0264103 A1 * 11/2006 Wei ..... 439/607

* cited by examiner

*Primary Examiner*—Hae Moon Hyeon
(74) *Attorney, Agent, or Firm*—WPAT, P.C.; Anthony King

(57) ABSTRACT

A connector is assembled by providing a base and an earth terminal unit which is located to be aligned with the base and the earth terminal unit is pressed into the base to let a front end of the earth terminal unit contact an inside of the base. A casing is then provided to be in alignment with the base and then press the casing into the base. A signal terminal unit is then provided which is in alignment with the base. The signal terminal unit is then pressed into the base and a front end of the signal terminal unit contacts the inside of the base. By the method, the signal terminal unit is securely connected to the base.

7 Claims, 13 Drawing Sheets

METHOD FOR ASSEMBLING CONNECTORS

BACKGROUND OF THE INVENTION

1. Field of the Invention

The present invention relates to a method for assembling connectors and the method ensures that the terminals are securely connected to the base of the connectors.

2. The Prior Arts

A connector is connected between a circuit board and signal lines so as to transfer signals from the signal lines to the circuit board to activate electrical components. The connector is important to ensure a desired quality of transportation of signals is obtained, especially for the signal strength and signal to noise ratio of LCDs, PDPs, and Low Voltage Difference Signal (LVDS). The terminals for transferring the noise out from the electrical component and the terminals for transferring signals to the circuit board need to be maintained in consistence at their relative positions so that it is important for a connector to allow all of the terminals to be in contact with the contact points of the circuits. Besides, in order to prevent the terminals to be loosened or deformed during separation of the terminals and the connector, the connection between the terminals and the connector is a crucial consideration. The conventional connectors lack proper positioning structure for securely accommodate the terminals so that the terminals might be loosened or deformed and the quality of transferring of signals is poor and unsatisfied.

The present invention intends to provide a method for assembling a connector and terminals wherein the terminals are securely engaged with the connector to improve the shortcomings found in the conventional connectors.

SUMMARY OF THE INVENTION

The present invention relates to a method for assembling connectors and the method comprises the following steps:

(1) providing a base and an earth terminal unit;

(2) aligning the earth terminal unit with the base;

(3) pressing the earth terminal unit into the base and a front end of the earth terminal unit contacting an inside of the base;

(4) providing a casing;

(5) aligning the casing with the base;

(6) pressing the casing into the base;

(7) providing a signal terminal unit;

(8) aligning the signal terminal unit with the base, and (9) pressing the signal terminal unit in the base and a front end of the signal terminal unit contacting the inside of the base.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
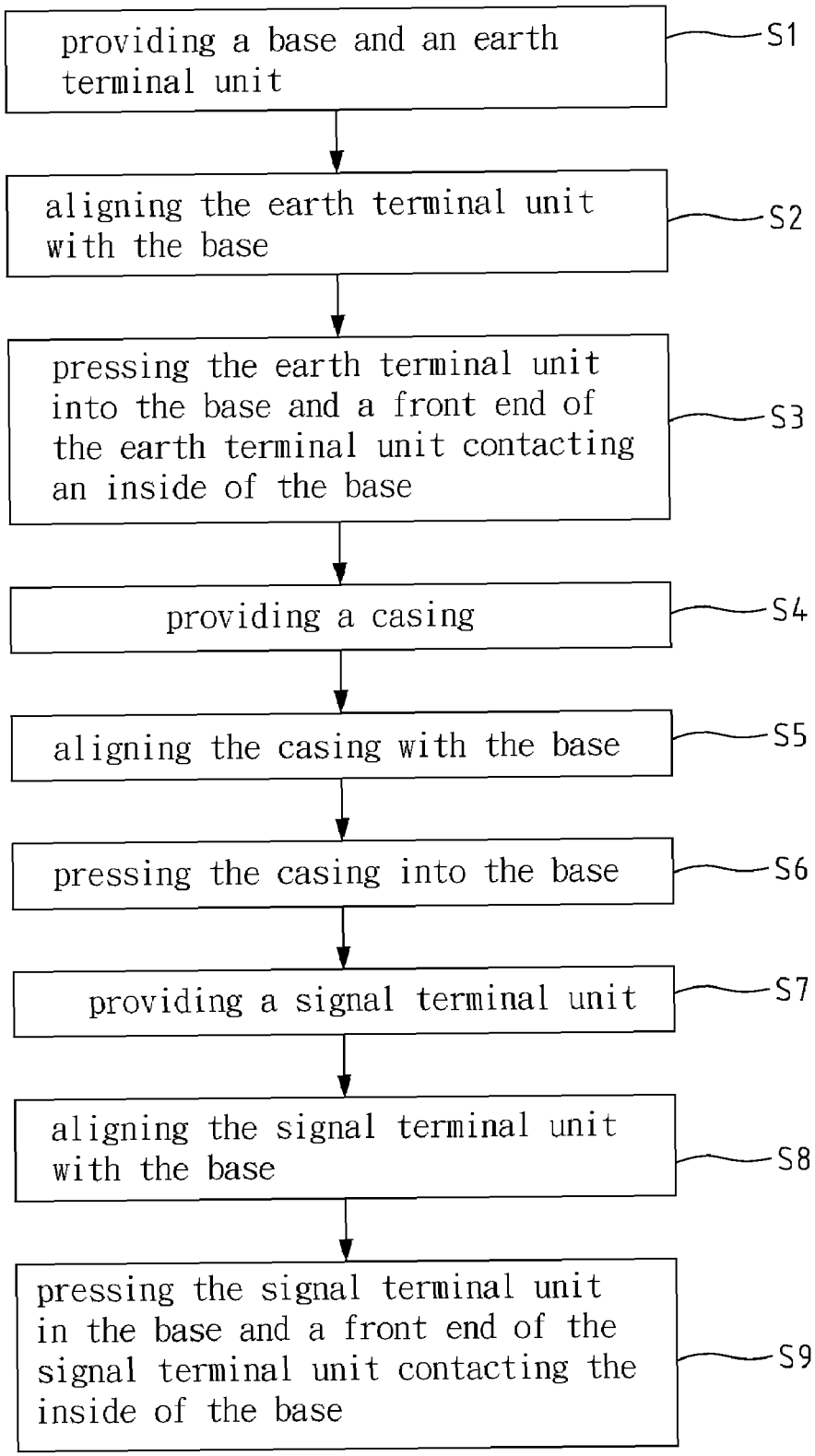
FIG. 1 shows the steps of the method of the present invention.

With reference to the drawings and in particular to FIG. 1, the method of the present invention comprises the following steps:

S1: providing a base 10 and an earth terminal unit 20;

S2: aligning the earth terminal unit 20 with the base 10;

S3: pressing the earth terminal unit 20 into the base 10 and a front end of the earth terminal unit 20 contacting an inside of the base 10;

S4: providing a casing 30;

S5: aligning the casing 30 with the base 10;

S6: pressing the casing 30 into the base 10;

S7: providing a signal terminal unit 40;

S8: aligning the signal terminal unit 40 with the base 10, and

S9: pressing the signal terminal unit 40 in the base 10 and a front end of the signal terminal unit 40 contacting the inside of the base 10.

Referring to FIGS. 2, 3, 4, 5A, 5B and 5C, the base 10 has a contact side 101, a top wall 102, a bottom wall and aback wall 103. A plurality of connection slots 14 are defined in the contact side 101 and a plurality of first slots 11 are defined in a lower surface of the connection slots 14. The first slots 11 are in communication with a plurality of first through holes 12 defined beneath the connection slots 14. A plurality of second slots 15 are defined in an upper surface of the connection slots 14 and in communication with a plurality of second through holes 16 defined above the connection slots 14. A first rib 13 is formed on the contact side 101 and located between each of the aligned first slot 11 and the first through hole 12. A second rib 17 is formed on the contact side 101 and located between each of the aligned second slot 15 and the second through hole 16.

Figure 6:
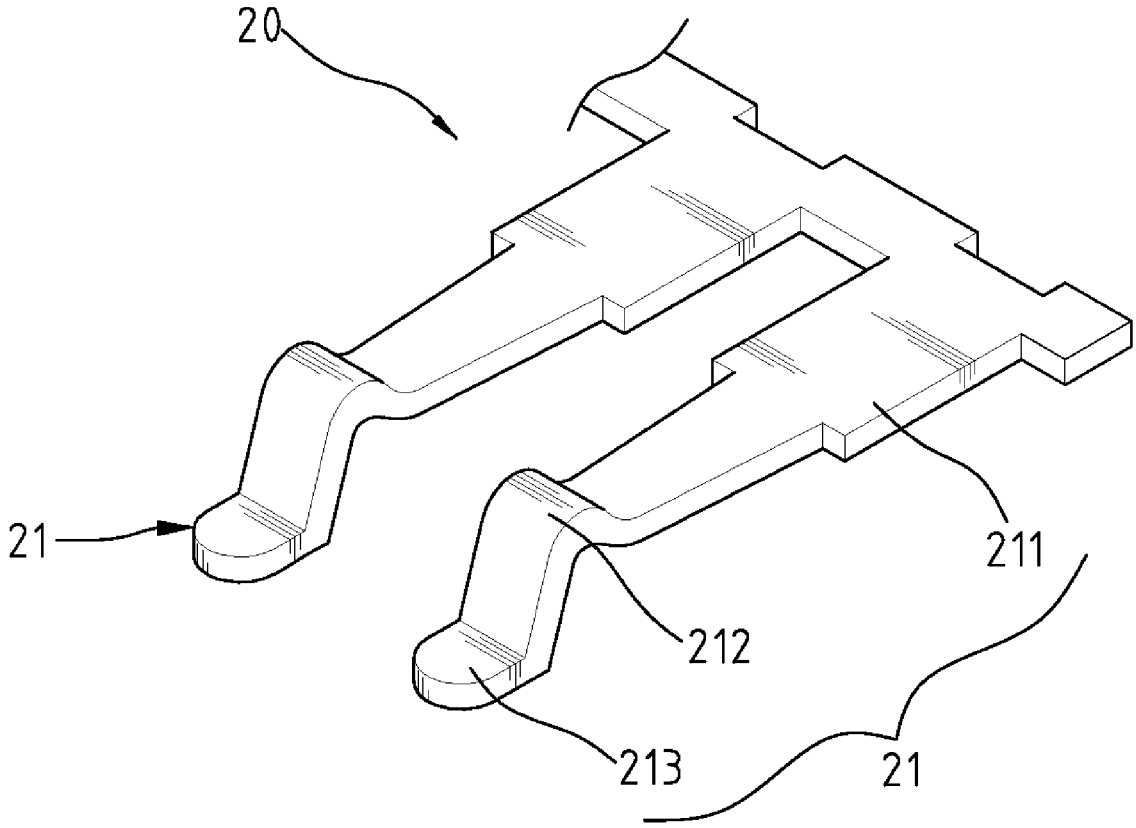
FIG. 6 shows a first embodiment of the legs of the earth terminal unit in the method of the present invention.
Figure 7:
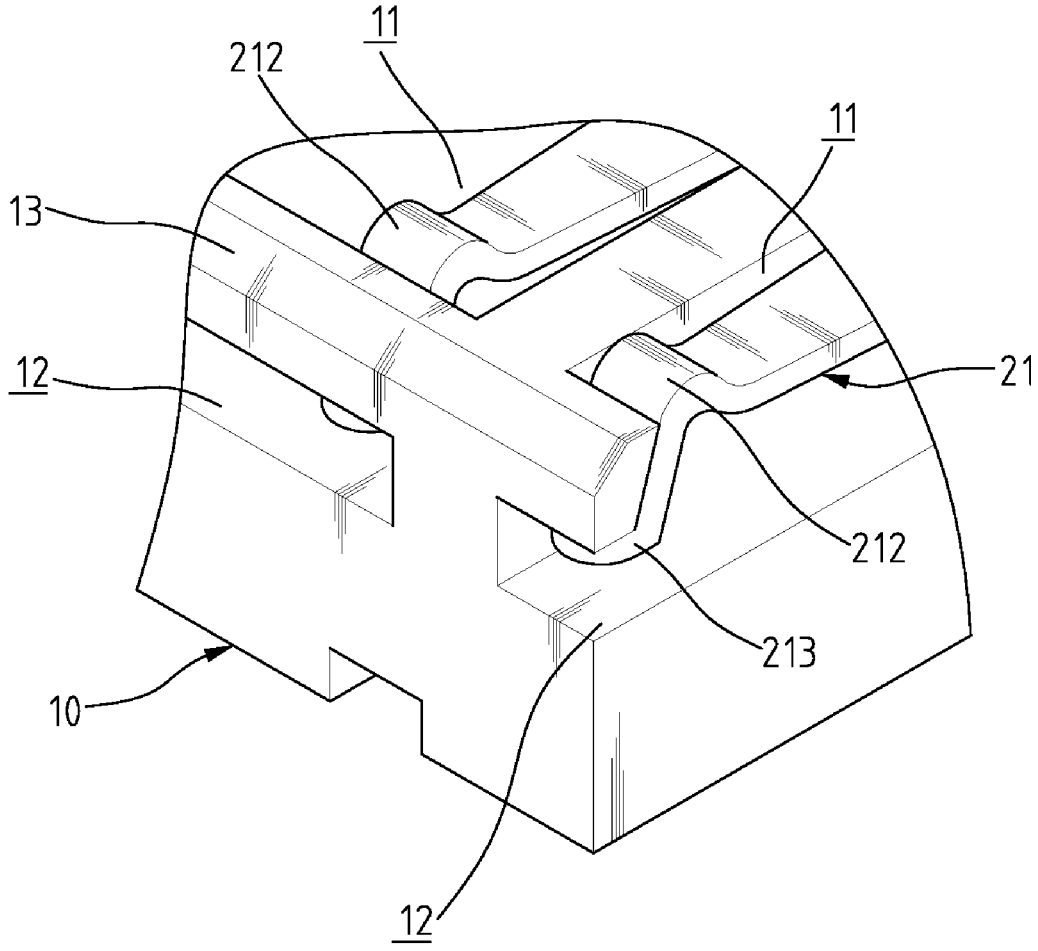
FIG. 7 shows that the legs of the earth terminal unit are inserted into the base in the method of the present invention.

Further referring to FIG. 6, the earth terminal unit 20 includes a plurality of first legs 21 which are inserted into the first through holes 12 respectively from the back wall 103 and each first leg 21 includes a first base portion 211 from which a curved first contact protrusion 212 extends. Each first contact protrusion 212 has a first tongue 213 extending therefrom and extends out from the first slot 11 corresponding thereto and is located in the connection slot 14 corresponding thereto. Each of the first tongues 213 extends through the first through hole 12 corresponding thereto and is in contact with a lower edge of the first rib 13 corresponding thereto as shown in FIG. 7.

Figure 9:
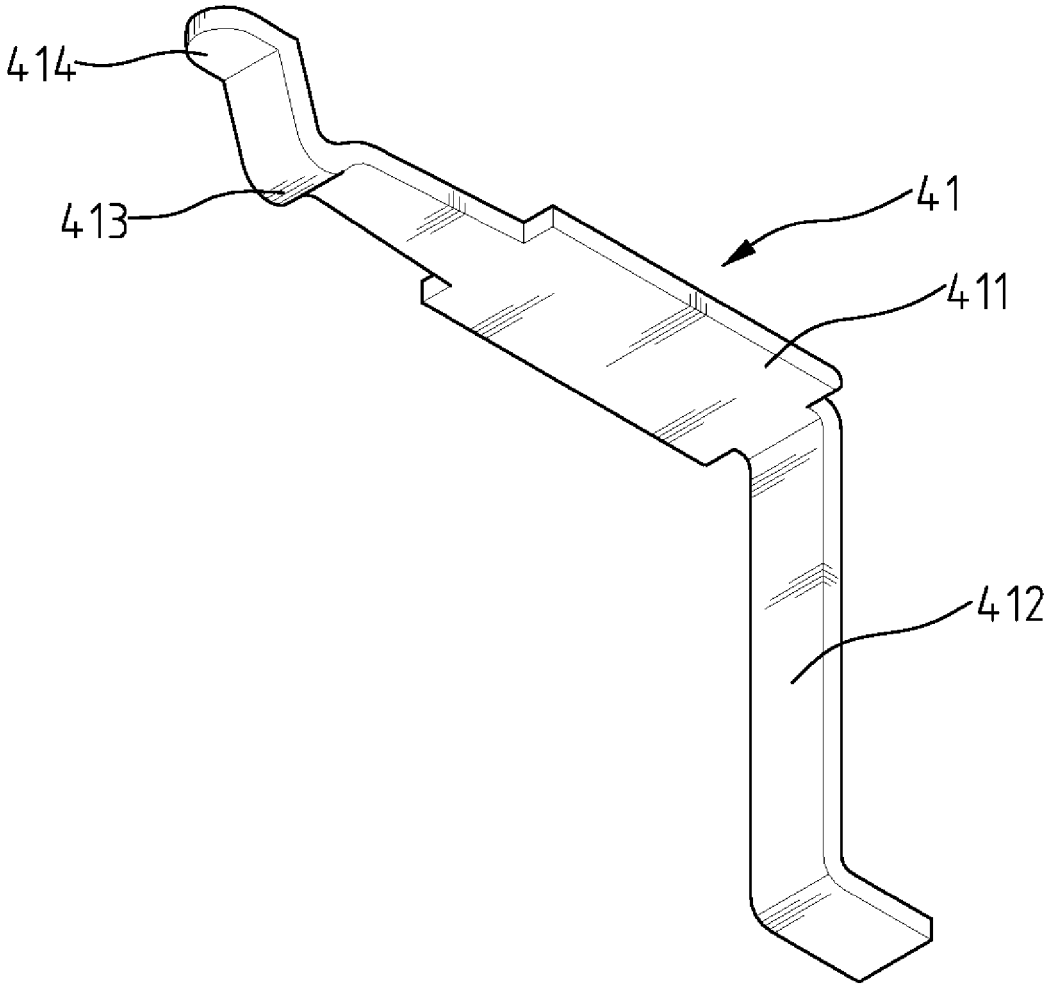
FIG. 9 shows a first embodiment of the legs of the signal terminal unit in the method of the present invention.
Figure 10:
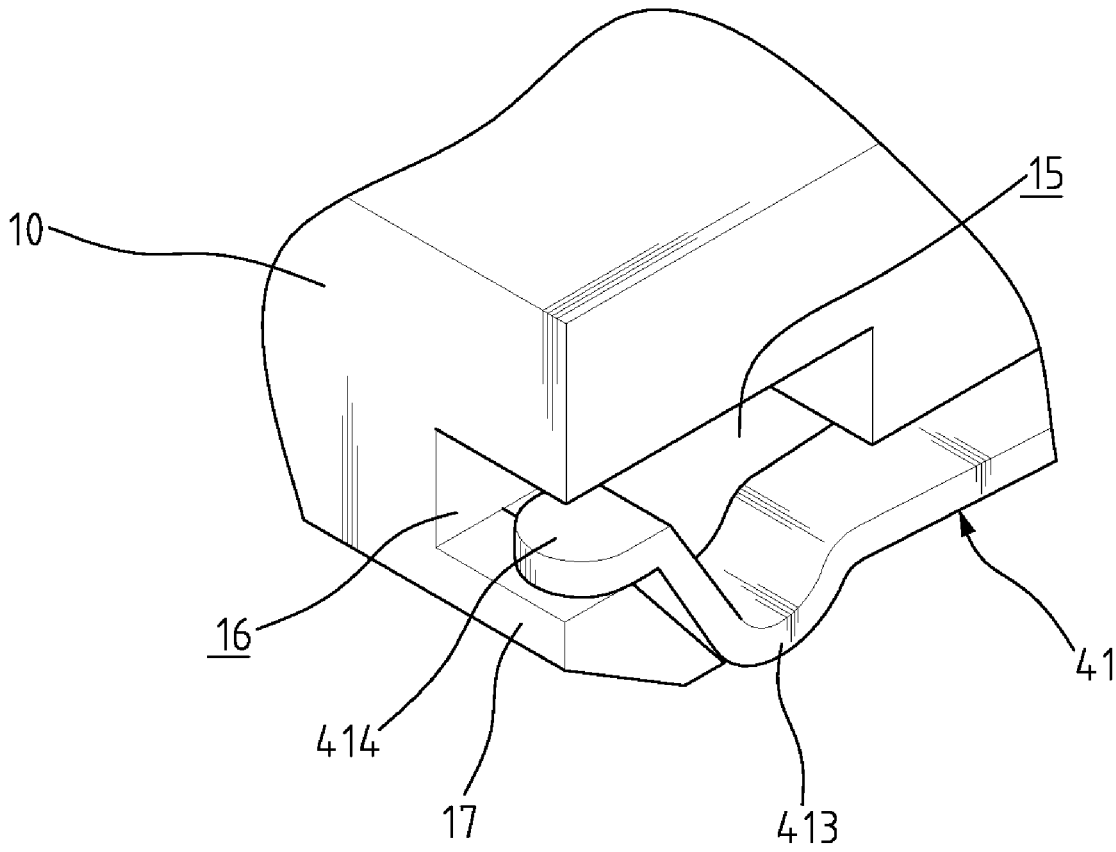
FIG. 10 shows that the legs of the signal terminal unit are inserted into the base in the method of the present invention.

Further referring to FIG. 9, the signal terminal unit 40 includes a plurality of second legs 41 which are inserted into the second through holes 16 respectively. Each second leg 41 includes a second base portion 411, a welding leg 412 and a curved second contact protrusion 413 extend two sides of the second base portion 411 respectively. Each second contact protrusion 413 has a second tongue 414 extending therefrom and extends out from the second slot 15 corresponding thereto and is located in the connection slot 14 corresponding thereto. Each of the second tongues 414 extends through the second through hole 16 corresponding thereto and is in contact with an upper edge of the second rib 17 corresponding thereto as shown in FIG. 10.

Figure 2:
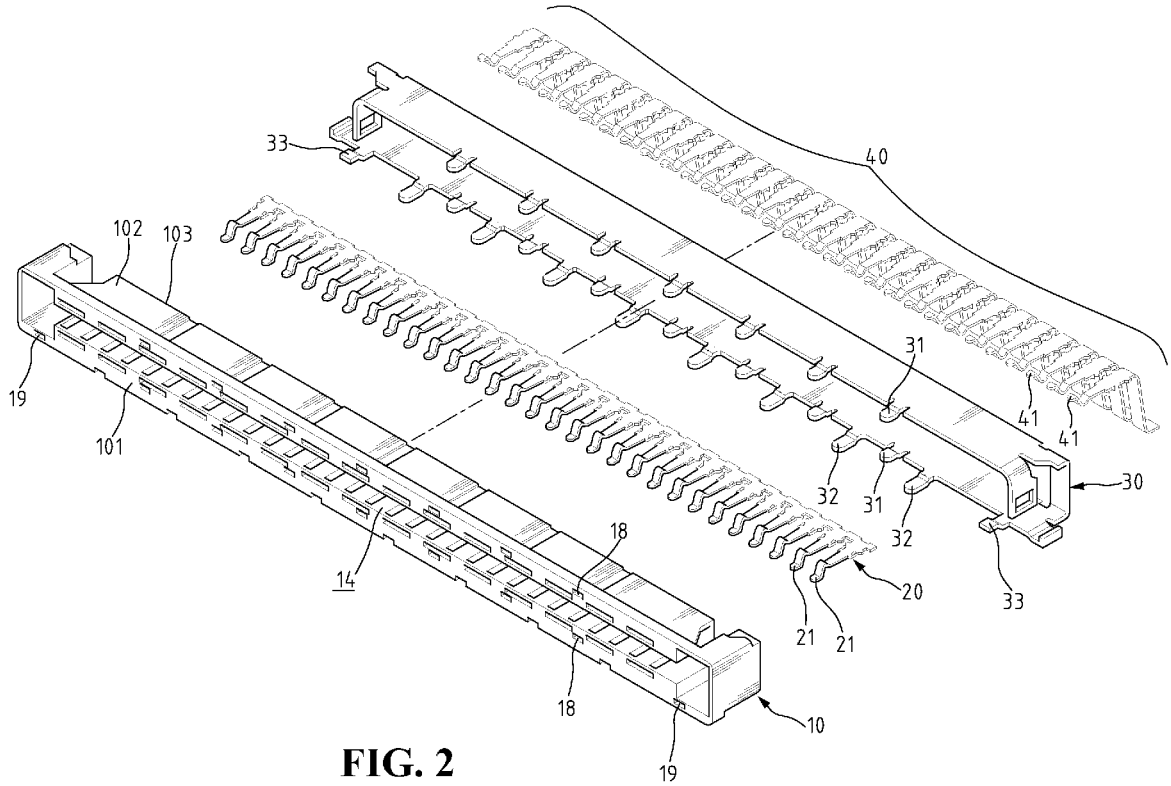
FIG. 2 is an exploded view of the connector in the method of the present invention.
Figure 3:
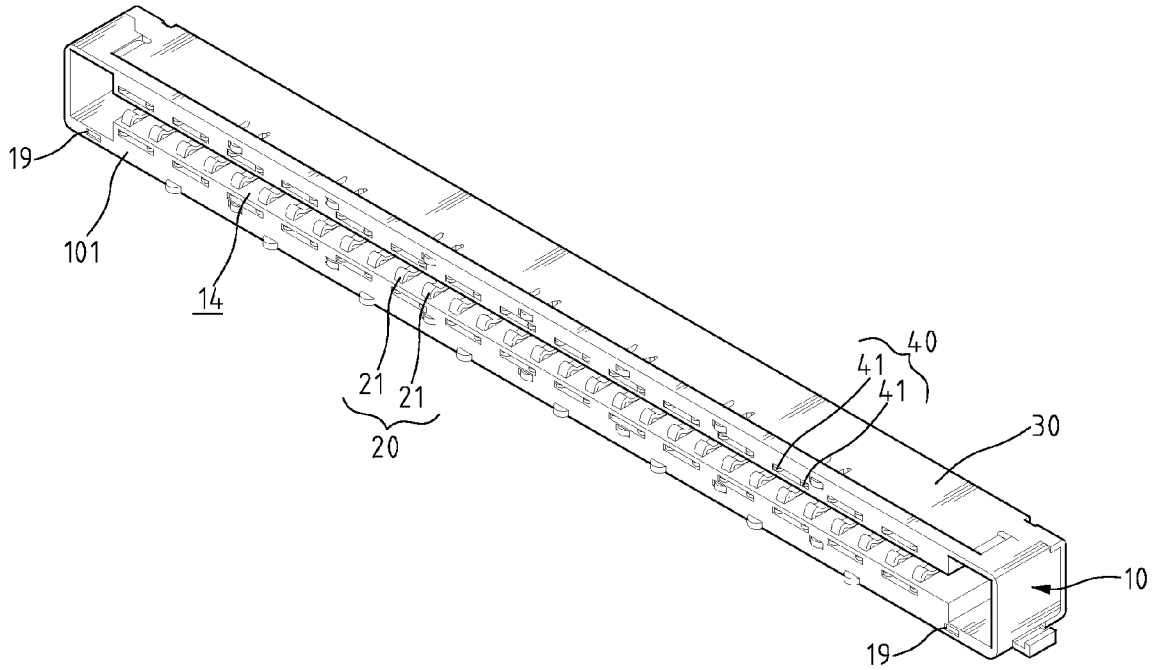
FIG. 3 is a perspective view to show the connector in the method of the present invention.
Figure 4:
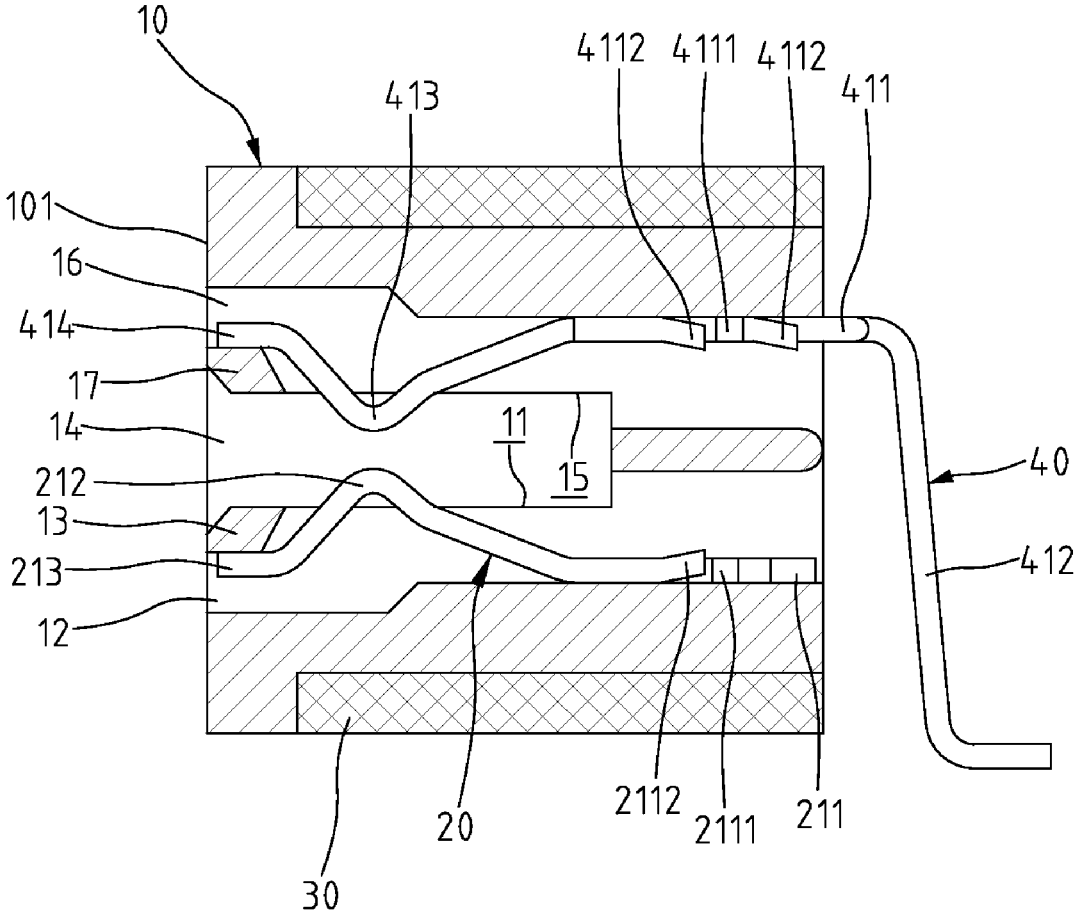
FIG. 4 is an enlarged cross sectional view to show the connection of one of the legs of earth terminal unit and one of the legs of the signal terminal unit in the base of the method of the present invention.
Figure 5A:
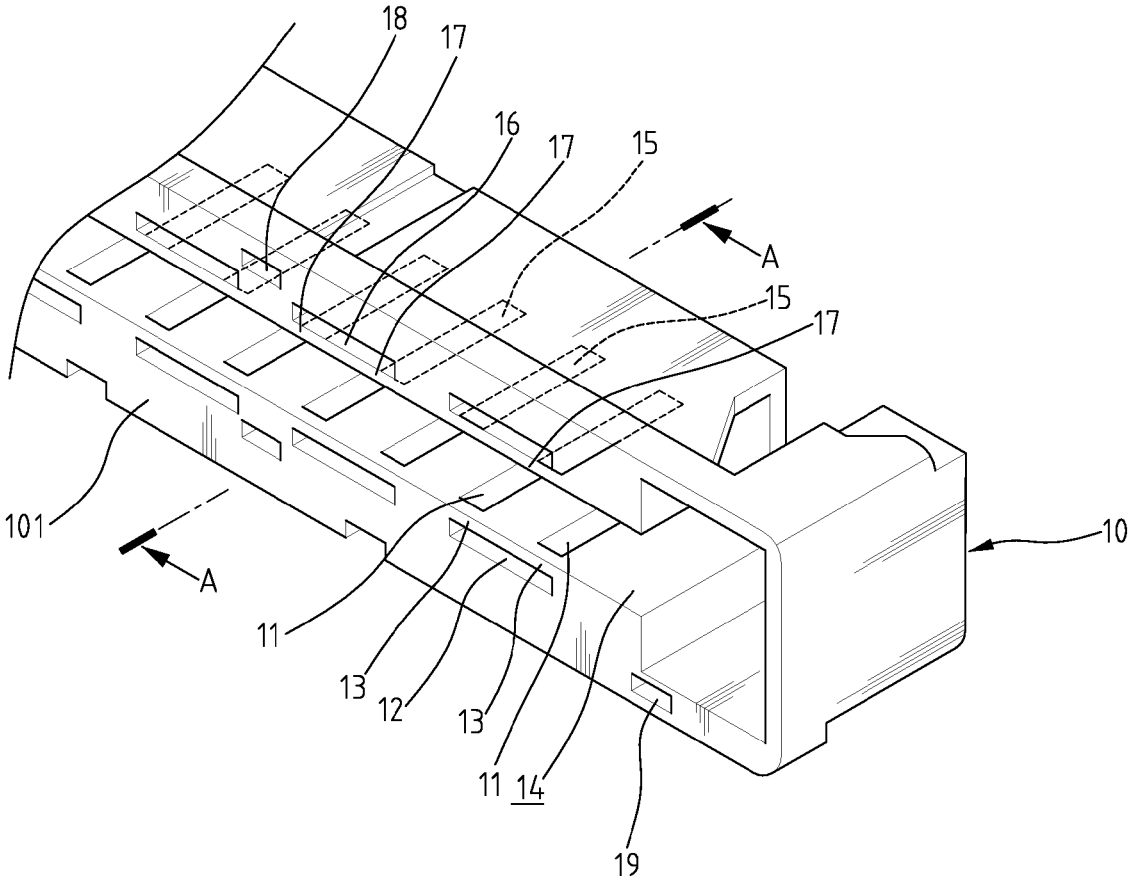
FIG. 5A shows a section of the base in the method of the present invention.
Figure 5B:
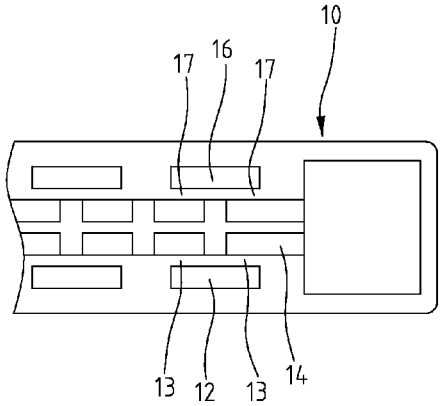
FIG. 5B shows a front view of the section of the base in the method of the present invention.
Figure 5C:
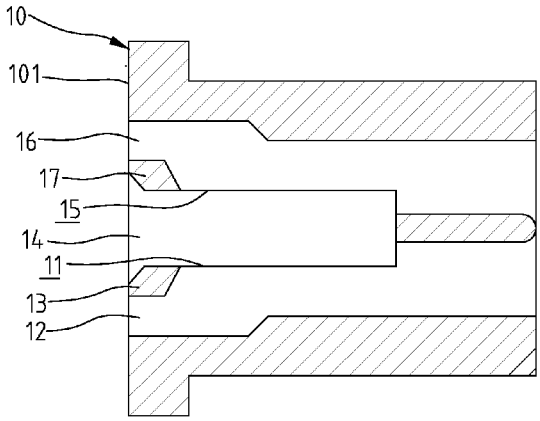
FIG. 5C shows a cross sectional view of the section of the base in the method of the present invention.
Figure 12:
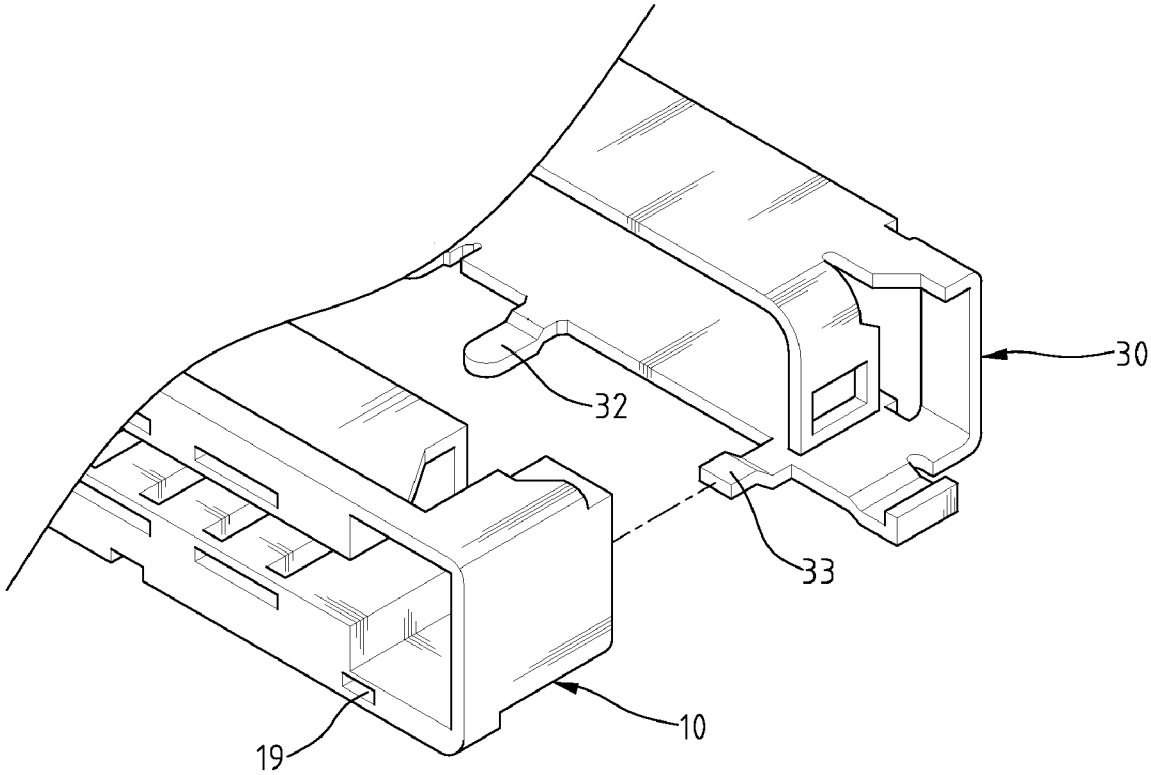
FIG. 12 shows the positioning studs on the casing and the positioning holes in the base in the method of the present invention.

Further referring to FIGS. 2 and 12, the casing 30 includes a plurality of connection studs 31 and bottom studs 32, and the base 10 has a plurality of connection holes 18 with which the connection studs 31 are engaged so as to connect the casing 30 to the base 10. The casing 30 further includes two positioning studs 33 on two ends thereof and the base 10 has two positioning holes 19 with which the positioning studs 33 are engaged.

By the engagement of the first tongues 213 and the first ribs 13, and the engagement of the second tongues 414 and the second ribs 17, the first legs 21 and the second legs 41 are ensured to be positioned at desired positions. In other words, the stable positioning of the first and second legs 21, 41 ensure that when the connector is connected with a circuit board (not shown), the contact terminals on the circuit board are firmly in contact with the first contact protrusions 212 and the second contact protrusions 414 so as to obtain high quality of signal transferring.

Figure 8:
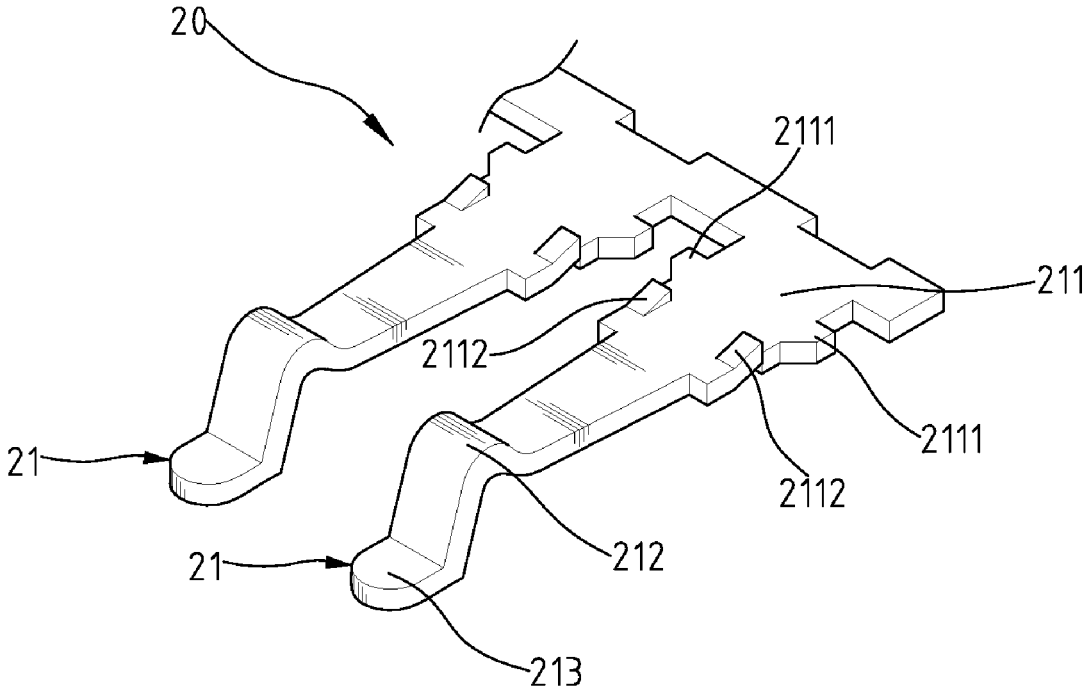
FIG. 8 shows a second embodiment of the legs of the earth terminal unit in the method of the present invention.

FIG. 8 shows a second embodiment of the first legs 21 of the earth terminal unit 20 wherein each of the first base portions 211 has a first side hook 2111 on each of two sides thereof and two upward hooks 2112 are formed on a top surface thereof. The number of the first side hooks 2111 and the upward hooks 2112 can be varied according practical needs. By the first side hooks 2111 and the upward hooks 2112, the base portions 211 of the first legs 21 are well positioned in the first through holes 12, and the first contact protrusions 212 are located in alignment with each other to provide better connection feature.

Figure 11:
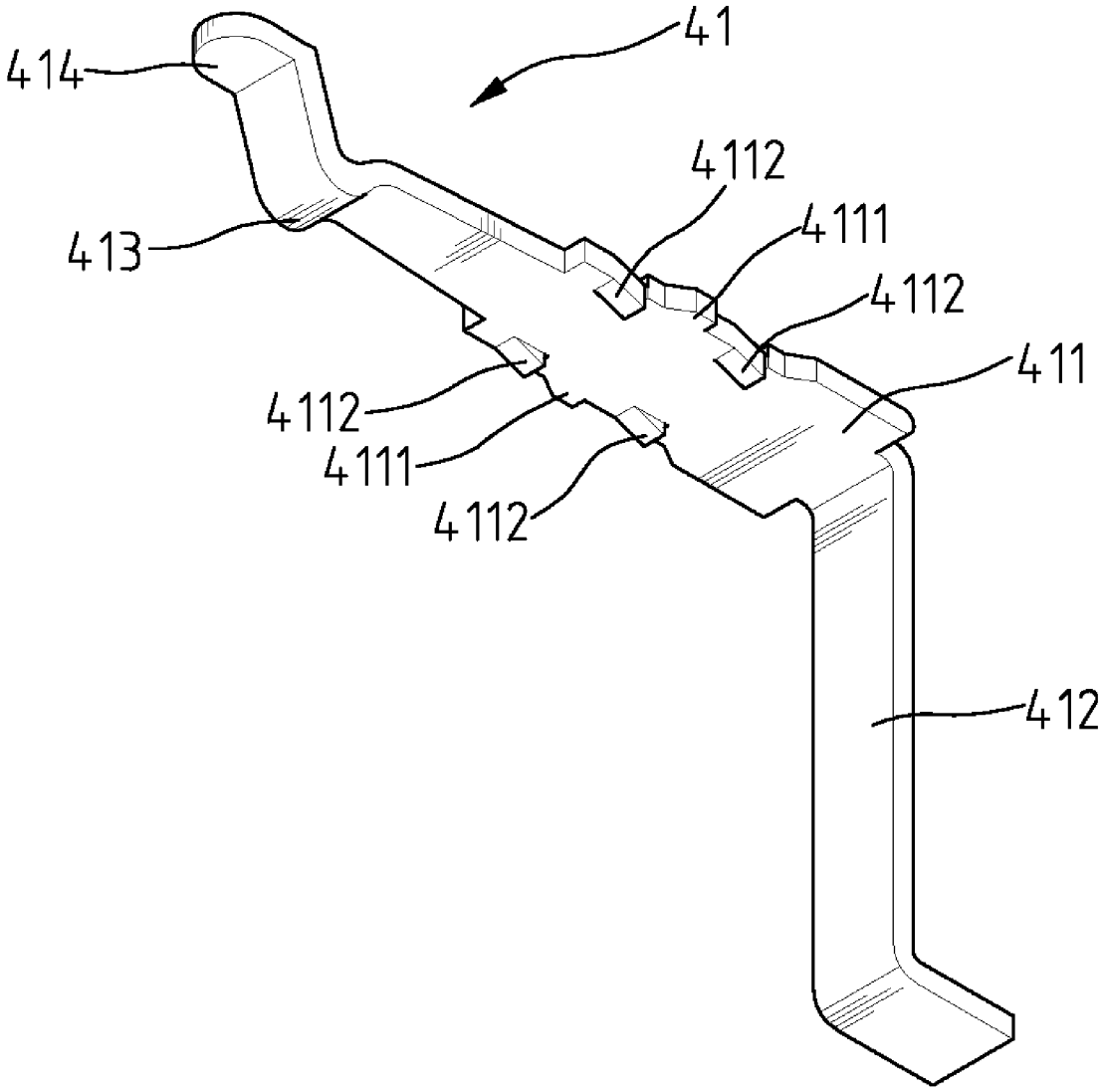
FIG. 11 shows a second embodiment of the legs of the signal terminal unit in the method of the present invention.

FIG. 11 shows a second embodiment of the second legs 41 of the signal terminal unit 40, wherein each of the second base portions 411 has a second side hook 4111 on each of two sides thereof and four downward hooks 4112 are formed on an underside thereof. Again, the number of the second side hooks 4111 and the downward hooks 4112 are not limited so that the second contact protrusions 413 are located in alignment with each other.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A method for assembling connectors, comprising the steps of:

(1) providing a base and an earth terminal unit;

(2) aligning the earth terminal unit with the base;

(3) pressing the earth terminal unit into the base and a front end of the earth terminal unit contacting an inside of the base;

(4) providing a casing;

(5) aligning the casing with the base;

(6) pressing the casing into the base;

(7) providing a signal terminal unit;

(8) aligning the signal terminal unit with the base;

(9) pressing the signal terminal unit in the base and a front end of the signal terminal unit contacting the inside of the base; and wherein the base has a contact side and a plurality of connection slots are defined in the contact side, a plurality of first slots are defined in a lower surface of the connection slots, the first slots are in communication with a plurality of first through holes defined beneath the connection slots, a plurality of second slots are defined in an upper surface of the connection slots and in communication with a plurality of second through holes defined above the connection slots, a first rib is formed on the contact side and located between each of the aligned first slot and the first through hole, a second rib is formed on the contact side and located between each of the aligned second slot and the second through hole, the earth terminal unit includes a plurality of first legs which are inserted into the first through holes respectively, each first leg includes a first base portion from which a curved first contact protrusion extends, each first contact protrusion has a first tongue extending therefrom, each of the first contact protrusions extends out from the first slot corresponding thereto and located in the connection slot corresponding thereto, each of the first tongues extends through the first through hole corresponding thereto and is in contact with a lower edge of the first rib corresponding thereto, the signal terminal unit includes a plurality of second legs which are inserted into the second through holes respectively, each second leg includes a second base portion and a welding leg and a curved second contact protrusion extend two sides of the second base portion, each second contact protrusion has a second tongue extending therefrom, each of the second contact protrusions extends out from the second slot corresponding thereto and located in the connection slot corresponding thereto, each of the second tongues extends through the second through hole corresponding thereto and is in contact with an upper edge of the second rib corresponding thereto.

2. The method as claimed in claim 1, wherein the casing includes a plurality of connection studs and the base has a plurality of connection holes with which the connection studs are engaged so as to connect the casing to the base.

3. The method as claimed in claim 2, wherein the casing includes two positioning studs on two ends thereof and the base has two positioning holes with which the positioning studs are engaged.

4. The method as claimed in claim 1, wherein each of the first base portions has at least one first side hook on two sides thereof.

5. The method as claimed in claim 1, wherein each of the first base portions has at least one upward hook on a top surface thereof.

6. The method as claimed in claim 1, wherein each of the second base portions has at least one second side hook on two sides thereof.

7. The method as claimed in claim 1, wherein each of the second base portions has at least one downward hook on an underside thereof.

* * * * *